US005125661A

United States Patent [19]

Jarboe

[11] Patent Number: 5,125,661

[45] Date of Patent: Jun. 30, 1992

[54] PUSH PIN COMBINATION LOCKING CONTAINER

[76] Inventor: Kent J. Jarboe, 147 Raymond St., Houma, La. 70363

[21] Appl. No.: 729,324

[22] Filed: Jul. 12, 1991

[51] Int. Cl.[5] ..... A63F 9/08; B65D 55/02

[52] U.S. Cl. ..... 273/156; 70/63; 70/68; 70/167

[58] Field of Search ..... 273/153 R, 153 S, 155, 273/156, 160; 446/8; 70/63, 71, 77, 287, 288, 289; 109/64; 217/5, 56

[56] References Cited

U.S. PATENT DOCUMENTS 3,115,762 12/1963 Nemsky ..... 70/63
3,514,981 6/1970 Esquibel et al. ..... 70/63 X
3,910,078 10/1975 Schulz ..... 70/287 X

*Primary Examiner*—William H. Grieb
*Assistant Examiner*—William M. Pierce
*Attorney, Agent, or Firm*—Leon Gilden

[57] ABSTRACT

A puzzle box includes a floor, side walls, a first end wall, and a second end wall to define a container, with a lid positioned to overlie the container, wherein the first end wall receives a through-extending shaft, wherein the side walls and second end wall include fixed block members. The shaft is directed through openings in flanges fixedly and orthogonally mounted to a bottom surface of the lid, wherein the shaft is only projected into the container through the first end wall and the remaining end walls and side walls are arranged to confuse availability of the shaft. A modification of the invention includes the floor formed with spring-biased rods selectively projected into the container, wherein the lid, when mounted on the container, includes locking blocks, wherein the locking blocks are positioned in locking engagement with the shaft and are in biased communication with the shaft. The rods are selectively projected into the container from the floor to displace engagement of the locking blocks with the shaft.

4 Claims, 4 Drawing Sheets

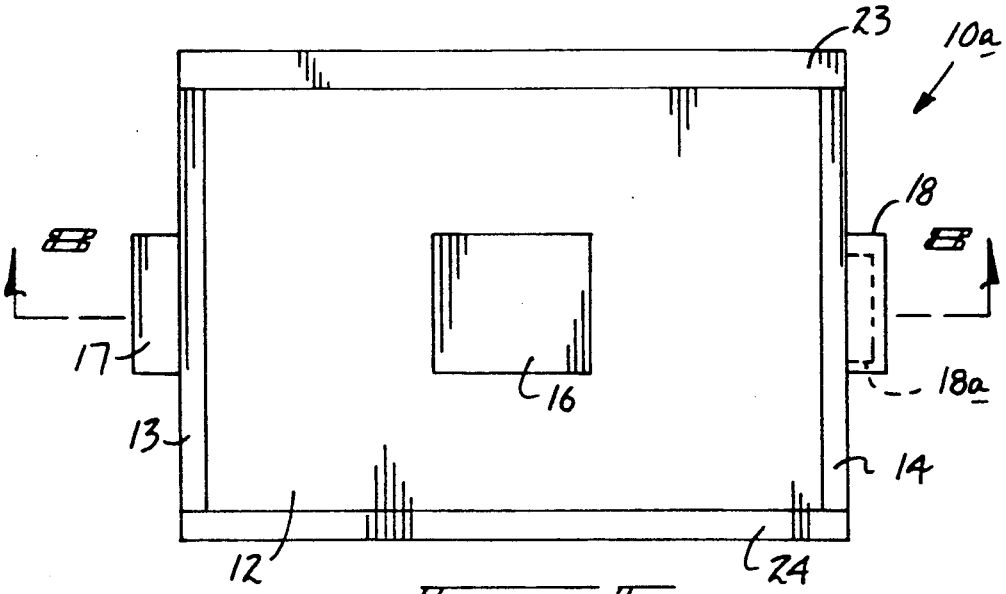
Fig 5
Fig 6
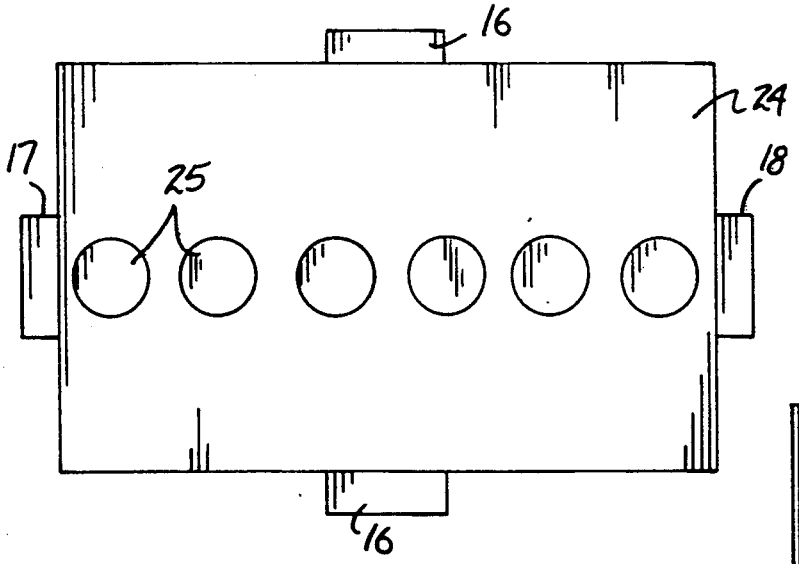
Fig 7
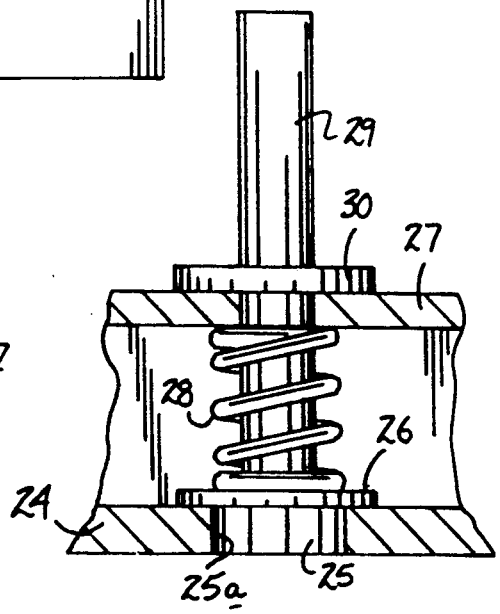

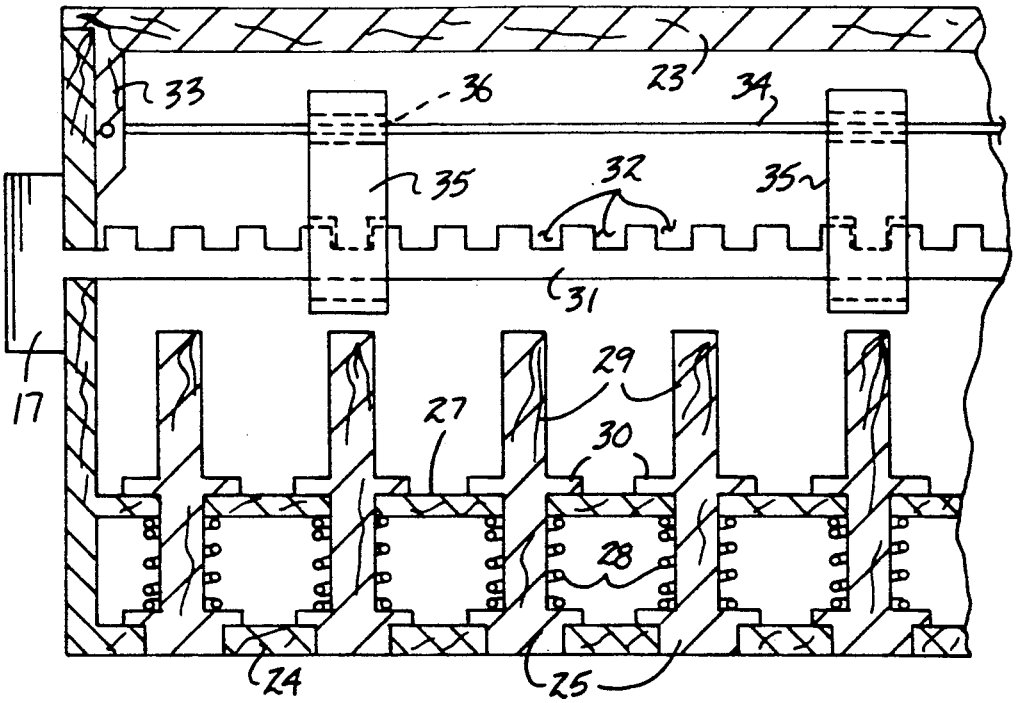
FIG 8
FIG 9
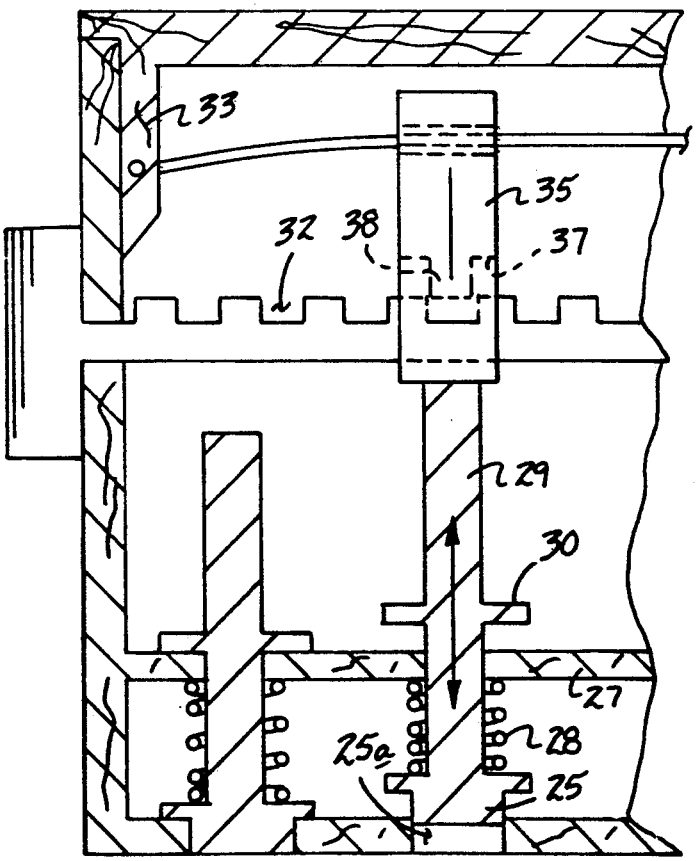

PUSH PIN COMBINATION LOCKING CONTAINER

BACKGROUND OF THE INVENTION

1. Field of the Invention

The field of invention relates to puzzle apparatus, and more particularly pertains to a new and improved puzzle box wherein the same is arranged to confuse availability of opening of the lid relative to the box.

2. Description of the Prior Art

Various puzzles of various types are set forth in the prior art to amuse and entertain individuals. Such apparatus may be found in U.S. Pat. No. 3,813,099 to Scott wherein a sphere and pin assembly is provided, wherein the pins are selectively inserted through a pair of openings within the sphere in underlying openings within the sphere.

U.S. Pat. No. 4,692,119 to Ussery sets forth a puzzle box of three-dimensional configuration, with a variety of threaded fasteners and tools utilized to assemble the fasteners into the box.

U.S. Pat. No. 3,612,537 to Sato set forth a box-like toy construction wherein the walls of the box include through holes in a manner to accommodate in a selective orientation various sizes of shafts directed into the box.

U.S. Pat. No. 4,811,948 to Gutierrez and U.S. Pat. No. 4,286,952 to Roche are further examples of educational and amusing puzzle boxes receiving shaft-like members through the puzzle box organization.

As such, it may be appreciated that there continues to be a need for a new and improved puzzle box as set forth by the instant invention which addresses both the problems of ease of use as well as effectiveness construction in providing an amusement and educational toy and in this respect, the present invention substantially fulfills this need.

SUMMARY OF THE INVENTION

The present invention provides a puzzle box including a floor, side walls, a first end wall, and a second end wall to define a container, with a lid positioned to overlie the container, wherein the first end wall receives a through-extending shaft, wherein the side walls and second end wall include fixed block members. The shaft is directed through openings in flanges fixedly and orthogonally mounted to a bottom surface of the lid, wherein the shaft is only projected into the container through the first end wall and the remaining end walls and side walls are arranged to confuse availability of the shaft. A modification of the invention includes the floor formed with spring-biased rods selectively projected into the container, wherein the lid, when mounted on the container, includes locking blocks, wherein the locking blocks are positioned in locking engagement with the shaft and are in biased communication with the shaft. The rods are selectively projected into the container from the floor to displace engagement of the locking blocks with the shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide a new and improved puzzle box which is of a durable and reliable construction.

Still yet another object of the present invention is to provide a new and improved puzzle box which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic front view of a modified puzzle box.

FIG. 6 is an orthographic bottom view of the modified puzzle box.

FIG. 7 is an orthographic cross-sectional illustration of a pleasure rod utilized by the invention, as set forth in FIGS. 5 and 6, FIG. 8 is an orthographic view, taken along the lines 8—8 of FIG. 5 in the direction indicated by the arrows.

FIG. 9 is an orthographic cross-sectional illustration of the puzzle box as set forth in FIG. 8, with the locking blocks in a displaced orientation relative to the shaft.

DESCRIPTION OF THE PREFERRED EMBODIMENT

Figure 1:
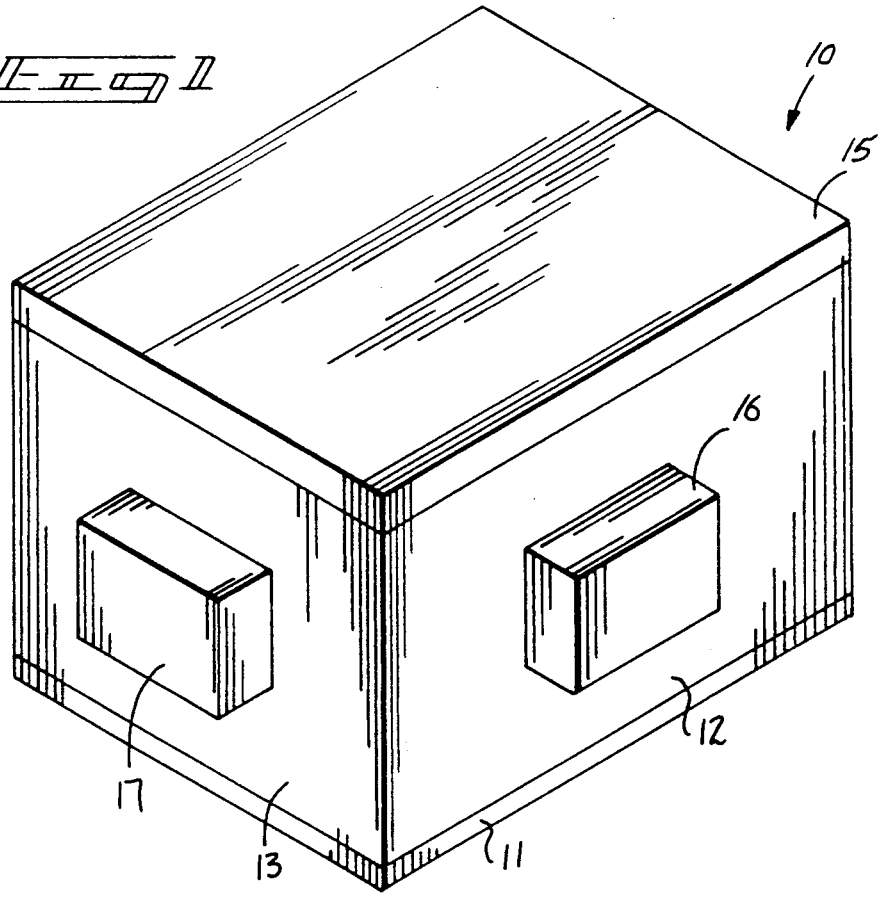
FIG. 1 is an isometric illustration of the invention.
Figure 2:
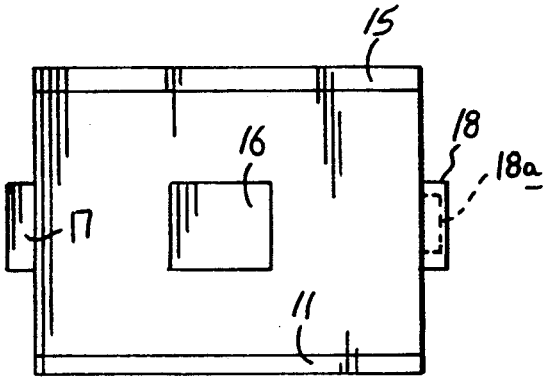
FIG. 2 is an orthographic front view of the invention.
Figure 3:
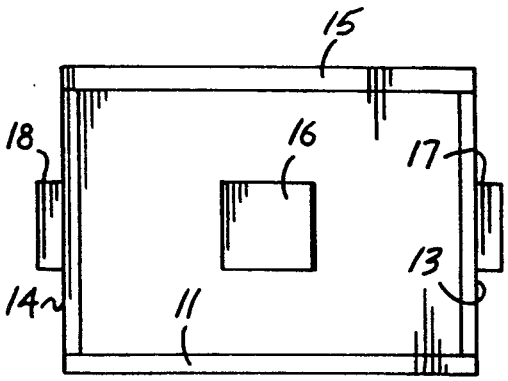
FIG. 3 is an orthographic rear view of the invention.
Figure 4:
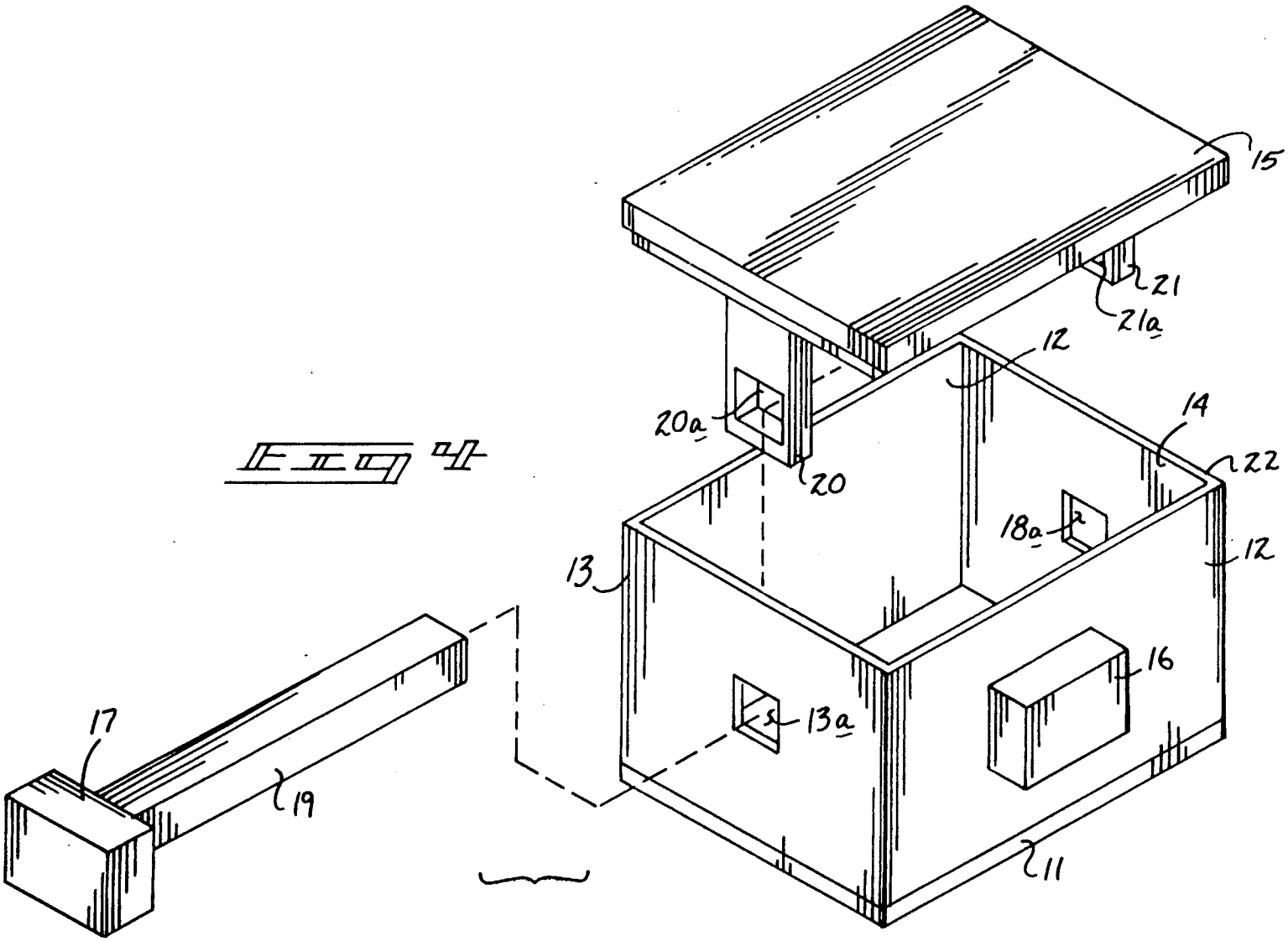
FIG. 4 is an isometric illustration of the invention in an exploded configuration.

With reference now to the drawings, and in particular to FIGS. 1 to 9 thereof, a new and improved puzzle box embodying the principles and concepts of the present invention and generally designated by the reference numerals 10 and 10*a* will be described.

More specifically, the puzzle box 10 of the instant invention essentially comprises a container defined by a floor 11, spaced parallel side walls 12, a first end wall 13 spaced from and parallel a second end wall 14. The end walls 13 and 14 are spaced apart a predetermined first length. The side walls include side wall blocks 16 mounted medially and fixedly thereto, with the first end wall including a first end wall block, and the second end wall including a second end wall block fixedly and medially mounted to the second end wall. The second end wall block 18 includes a second end wall block socket 18*a* projecting into the second end wall block 18. The first end wall block 17 is fixedly and orthogonally mounted to an upper terminal end of a parallelepiped shaft 19 defined by a second length greater than the first length to project through the first end wall through a first end wall opening 13*a* that is aligned with the second end wall socket 18*a*. A lid plate 15 is selectively mounted to overlie a continuous and coplanar top edge 22. When the lid is in contiguous communication with the top edge 22, the lid including a respective first and second flange 20 and 21 that are arranged parallel relative to one another, and each including a respective first and second flange opening 20*a* and 21*a* are each aligned with the respective first end wall opening 13*a*, the second end wall socket 18*a* to receive the shaft 19 through the first and second flange openings 20*a* and 21*a*. The openings 13*a*, 20*a*, 21*a*, and 18*a* are each of a rectangular cross-sectional configuration to complementarily receive the shaft 19 therethrough. In this manner, the blocks 16 and 18 are arranged to mask the first end wall block 17 to confuse a participant or player as to which block may be withdrawn to permit removal of the lid relative to the thusly formed container.

FIG. 5 illustrates a modified puzzle box 10*a*, wherein the modified puzzle block includes a modified lid 23 mounted to the container, with a modified floor 24 fixedly mounted to the container at a bottom edge of the end walls and side wall, as illustrated in FIG. 5 for example. Modified floor 24 includes a series of equally spaced plunger head bores 25*a* slidably receiving a plunger head 25 therewithin. Each plunger head 25 includes a plunger head flange 26 extending radially and laterally of the plunger head 25 of a diameter greater than the predetermined diameter defined by the plunger head 25. The plunger head flange 26 receives a spring member 28 in abutment therewith, wherein an opposing end of the spring 28 is in abutment with a bottom surface of a further floor 27. The plunger head 25 includes a plunger rod 29 coaxially and fixedly mounted to the bottom surface of the plunger head projecting from the plunger head 25 through the further floor 27, with a plunger rod flange 30 fixedly mounted and extending laterally of the rod 29 and spaced from the first flange or plunger head flange 26 a spacing substantially equal to a spacing defined between a top surface of the floor 24 and a top surface of the further floor 27. In this manner, the plunger rod 29 is selectively projected into the container, as illustrated in FIGS. 8 and 9. The modified lid 23 includes a plurality of lid flanges 33 extending downwardly and positioned within interior surfaces of the first and second end walls 14, in a manner as typified in FIGS. 8 and 9. A spring plate 34 is mounted between the lid flanges 33. The modified shaft member 31 mounted to the first end wall block 17 includes a series of spaced slots 32. The lid flange 33 slidably mounts a plurality of locking blocks 35 thereon. Each locking block 35 includes a first bore 36 to receive the spring plates slidably therethrough, with a second bore 37 arranged to receive the modified shaft member 31 therethrough. The second bore 37 includes a second bore projection 38 medially and radially projecting into the second bore 37 and in engagement with one of the slots 32. In this manner, the proper plunger rods 29 of the plurality of plunger rods must be projected interiorly of the box, as illustrated in FIG. 9, to displace each bore projection 38 of each block 35. When this is accomplished the modified shaft member 31 may be withdrawn from interiorly of the container to permit removal of the lid therefrom.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A puzzle box, comprising, a container, including a floor, the floor including opposed sides, the floor orthogonally mounting a plurality of side walls to the opposed sides of the floor, wherein the side walls are arranged parallel relative to one another, and a first end wall mounted to a first end of the floor, and a second end wall mounted to a second end of the floor to define a container, the side walls, first end wall, and second end wall including a top coplanar edge oriented parallel relative to the floor, and a lid plate, the lid plate selectively securable to the container in contiguous communication with the top coplanar edge, and the first end wall including a first end wall opening, the side walls each including a side wall block member fixedly mounted medially to each exterior surface of each side wall, and the second end wall including a second end wall block, wherein the second end wall block is longitudinally aligned with the first end wall opening, and the first end wall block includes a first end wall socket formed within the first end wall block, and the first end wall is spaced from the second wall defined by a predetermined first length, and including a shaft member, the shaft member defined by a second length greater than the predetermined first length, and the parallel shaft complementarily received through the first end wall opening and within the parallelepiped shaft, and the parallelepiped shaft including a first end wall block member fixedly mounted to the parallelepiped shaft at a first end thereof, and wherein the lid plate includes a lid plate bottom surface, the plate bottom surface including a first flange and a second flange, the first and second flanges spaced apart a predetermined spacing to be received within the first end wall and the second end wall, and wherein the first flange and the second flange include a spring plate mounted therebetween, and the spring plate includes a plurality of locking blocks slidably mounted about the spring plate, and the locking blocks each including a first bore to receive the spring plate therethrough, and each locking block including a second bore to slidably receive the shaft therethrough when the lid plate is mounted to the top coplanar edge.

2. A puzzle box as set forth in claim 1 wherein the shaft includes a plurality of spaced slots, and each of the second bores of the locking blocks includes a bore projection projecting radially and medially of each second bore, wherein each bore projection is received within one of said spaced slots within the shaft to secure the shaft within the container.

3. A puzzle box as set forth in claim 2 including a further floor positioned interiorly of the container spaced above the floor, and the floor including a series of spaced plunger head bores, each plunger head bore reciprocatingly mounting a plunger head therewithin, and each plunger head including a plunger head flange positioned interiorly of the container, and a spring member captured between each plunger head flange and a bottom surface of the further floor, and a plunger rod extending medially of each spring extending from the plunger rod through the further floor to a spaced relationship below the shaft.

4. A puzzle box as set forth in claim 3 wherein each plunger rod includes a plunger rod flange, the plunger rod flange is spaced from the plunger head flange a predetermined spacing, and a top surface of the floor and a top surface of the further floor spaced apart the predetermined spacing, wherein the spring member normally biases the plunger head flange and the plunger rod flange into contiguous communication with the respective floor and further floor, and each plunger head is selectively and manually displaceable relative to the floor when positioned under a locking block to displace the bore projection from the shaft.

* * * * *